US006537326B1

(12) United States Patent
McKinnon et al.

(10) Patent No.: US 6,537,326 B1
(45) Date of Patent: Mar. 25, 2003

(54) METHOD FOR SIGNIFICANTLY ENHANCING THE QUALITY OF SCOURED WOOL AND MACHINERY FOR ACHIEVING THOSE ENHANCEMENTS

(75) Inventors: Alan John McKinnon, Christchurch (NZ); John Robert McLaughlin, Canterbury (NZ); Murray Edwin Taylor, Canterbury (NZ); Douglas Alexander Rankin, Christchurch (NZ); Paul Gregory Middlewood, Christchurch (NZ); Phillipa Le Pine, Christchurch (NZ); Paul Johannes Roy Mesman, Christchurch (NZ); Stephen Barry Manson, Christchurch (NZ)

(73) Assignee: Wool Research Organisation of New Zealand, Inc., Canterbury (NZ)

( * ) Notice: Subject to any disclaimer, the term of this patent is extended or adjusted under 35 U.S.C. 154(b) by 0 days.

(21) Appl. No.: 09/509,359

(22) PCT Filed: Sep. 25, 1998

(86) PCT No.: PCT/NZ98/00144

§ 371 (c)(1),
(2), (4) Date: Jul. 5, 2000

(87) PCT Pub. No.: WO99/16942

PCT Pub. Date: Apr. 8, 1999

(51) Int. Cl.[7] ..... D01B 3/04; D01C 3/00

(52) U.S. Cl. ..... 8/111; 8/128.1; 8/139; 8/139.1; 8/598

(58) Field of Search ..... 8/139, 139.1, 128.1, 8/598

(56) References Cited

U.S. PATENT DOCUMENTS

| | | | | |
|---|---|---|---|---|
| 3,234,124 | A | * | 2/1966 | Irani |
| 3,619,116 | A | * | 11/1971 | Saville |
| 3,636,736 | A | * | 1/1972 | Terasawa et al. |
| 3,871,820 | A | * | 3/1975 | Stewart et al. |
| 4,349,347 | A | | 9/1982 | Masri et al. |
| 5,084,066 | A | * | 1/1992 | Arifoglu et al. |

FOREIGN PATENT DOCUMENTS

| | | |
|---|---|---|
| GB | 616477 | 1/1949 |

OTHER PUBLICATIONS

Derwent Abstract 94–2017461/25 of EP 603662 A1, Jun. 29, 1994.

* cited by examiner

*Primary Examiner*—Margaret Einsmann
(74) *Attorney, Agent, or Firm*—Dykema Gossett PLLC

(57) ABSTRACT

A wool or the like fiber scour including at least one of the following, (a) scouring process wherein the fiber is subjected to an acid extraction process to remove absorbed iron, and by to greatly improve the brightness (Y tristimulus value) of the wool; (b) a scouring process wherein a bleaching process is carried out part way through the wet process following by dying, rewriting and chemical reduction, therefore stabilising the bleached color to prevent subsequent reversion in the dyebath; or (c) a scouring process wherein scoured clean fiber is dried and dusted, and then reimmersed in liquors containing detergents and dispersants, thereby effectively removing extra amounts of residual dirt. The scour produces an improved quality of fibres.

12 Claims, 4 Drawing Sheets

METHOD FOR SIGNIFICANTLY ENHANCING THE QUALITY OF SCOURED WOOL AND MACHINERY FOR ACHIEVING THOSE ENHANCEMENTS

FIELD OF THE INVENTION

This invention relates to a new method of scouring and chemically processing wool or other like fibre in a modified scour in order to produce scoured fibres very much improved in respect of a number of important quality parameters. This process is for brevity and convenience referred to as "Superscouring".

BACKGROUND TO THE INVENTION

It has been recognised by the inventors for several years that the dull appearance of wool is related in large part to the presence in the wool of iron staining. It has also been recognised by the inventors that this internal co-ordinated iron can be removed by a process involving extraction of the wool with an acid solution, at a pH of not more than 3, preferably 2.0–3.0, in the presence of a metal sequestering agent such as ethylene diamine tetra-acetic acid (EDTA).

The inventors demonstrated several years ago that wool so extracted was capable of achieving a brightness improvement of some 4–6 Y units. However, this technology was for several reasons not capable of being effectively carried out within conventional woolscours. Exploiting this technology has hitherto required a double-pass processing operation through a conventional set of process bowls. This invention details alternative procedures that can be integrated into a single continuous process operation.

Peroxide bleaching is a well-known adjunct to conventional wool scouring in New Zealand and elsewhere. The usual process involves passage of the wool through a hot bowl (invariably the final bowl in the train) containing from 1–10 g/l of hydrogen peroxide, with high pressure squeezing, and entry to a wool dryer where most of the bleaching occurs (although some may continue in the baled wool). However, this form of peroxide bleaching has a major disadvantage in that when the wool is dyed, peroxide residues present in the fibre initiate yellowing reactions which cause the substrate colour of the product being dyed often to be poorer than the original unbleached wool. This phenomenon is dubbed "colour reversion".

The inventors and their colleagues demonstrated some years ago that colour reversion may be prevented by pretreating the wool prior to dyeing with a suitable reducing agent such as sodium bisulphite or sodium dithionite. These reducing agents destroy the peroxidic residues, and thereby prevent colour reversion. Such a reducing step is not possible in a conventional scour but can be readily achieved in the proposed configuration of attached FIGS. 1(*a* to *d*), or other variants of machine layouts suitable for 'Superscouring'.

The inventors have found in other related technology for carpet yarn scouring that residual soil on wool may be removed through the combined actions of detergents and dispersing agents. However, in conventional wool scouring the use of dispersants, though often promoted, is not normally cost effective because of the levels of suspended solids contamination of the liquors and the inherent dispersing potential of the suint salts in the more contaminated bowls.

SUMMARY OF THE INVENTION

The invention therefore provides in a wool or the like fibre scour at least one of the following:

(a) a scouring process wherein the fibres are subjected to an acid extraction process to remove absorbed iron, and thereby to greatly improve the brightness (Y tristimulus value) of the fibres.

(b) a scouring process wherein a bleaching process is carried out in a bowl or pad part way through the wet process, following by drying, rewetting, and chemical reduction, therefore stabilising the bleached colour to prevent subsequent reversion in the dyebath.

(c) a scouring process wherein scoured clean fibres are dried and dusted, and then reimmersed in liquors containing detergents and dispersants, thereby effectively removing extra amounts of residual dirt.

(d) a scouring process in which, by two separate stages of wet processing, residual grease and residual pesticide levels can be greatly reduced, thereby minimising dangers of market resistance associated with traces of animal-remedy pesticides.

Alternatively or in addition the scouring process can involve drying the wool at both an intermediate and final stage, in which the drying operations can be conveniently and economically carried out by combining them within one integrated drying module.

The invention also provides:

(a) a scoured wool produced by the means of (a)–(d) which presents to the yarn spinner or processor a product offering superior colour and processing performance and freedom from iron-related discoloration problems in wet processing.

(b) a scoured wool also produced thereby that contains less dust and residual soil and thereby offers to the processors advantages of a safer working environment, and improved processing performance.

(c) a process whereby, by both improvements in chemical processing and plant design, all the above benefits of (a)–(d) may be achieved cost-effectively in a single pass through a machine of modest linear extent, compact arrangement, and reasonable cost.

This invention allows these improved qualities to be achieved concurrently in a single pass through a substantially revised configuration of scouring machinery components.

The applicant specifically considers there is novelty in some of the individual chemical processing steps, and in the combination of chemical processing steps within the complete operation to achieve specific results, and for aspects of the equipment in which the process is carried out.

The applicant believes there is novelty for the particular sequence and layout of plant components, including the utilisation if desired of a double-pass dryer configuration.

The particular quality improvements provided by the modified process are:

major improvements in the brightness of scoured wool, as measured by its Y tristimulus value, measured on wool in the 'as-is' state as it comes from the scour. On good-quality New Zealand crossbred fleece wools these increases may be as high as 8–9 units in Y, compared to conventionally scoured wool.

stability of the enhanced colour of the wool to subsequent dyeing, in contrast to conventional bleaching processes, where much of the colour benefit is lost by a yellowing process occurring during dyeing.

very large reductions (on a proportionate basis) of residual grease levels on the scoured wool, down to virtually negligible remaining levels of superficial woolgrease (as distinct from internal wool lipids), which in turn mean that the levels of residual lipophilic ectoparasiticides on the wool are sufficiently reduced to comply with pesticide content regulations.

very substantially reduced contamination of the wool by finely divided residual soil particles, thereby producing not only a brighter wool but one which avoids downstream processing problems associated with residual dirt.

a wool that is comparatively dust free compared to conventionally scoured wool.

a wool that is substantially reduced in its iron content, both as to the iron associated with residual dirt, and the iron that is chemically absorbed and bound within the fibre.

The methods by which each of these improvements may be achieved within proposed machinery configurations are described in turn in the following sections.

The applicant proposes an efficient and logistically acceptable plant configuration in which this process can be incorporated into a single process pass.

The specific requirements which enable this chemical process to be carried out with acceptable efficiency and consistency are that the wool must be in a quite clean state before being acid-treated, that the levels of suspended matter in the bowls must be very low, to avoid redeposition on the wool, and that the levels of dissolved ionic material (predominantly suint salts) carried forward into the acid treatment bowl are very low. These requirements are achieved in the plant configuration described below and shown in FIGS. 1(*a* to *d*), and in alternative layouts which incorporate similar overall wet processing stages and intermediate drying and dusting stages.

While acid extraction considerably improves the Y tristimulus value, the Z tristimulus value is improved somewhat less, so that the perceived yellowness of the wool also increases. This disadvantage may be eliminated, with further enhancement of both Y and Z, by the second aspect of colour improvement as described below.

DESCRIPTION OF THE DRAWINGS

The plant configuration shown in FIGS. 1(*a* to *d*) incorporates a number of features, brief details of which are detailed in Table 1 below.

TABLE 1

Figure 1A:
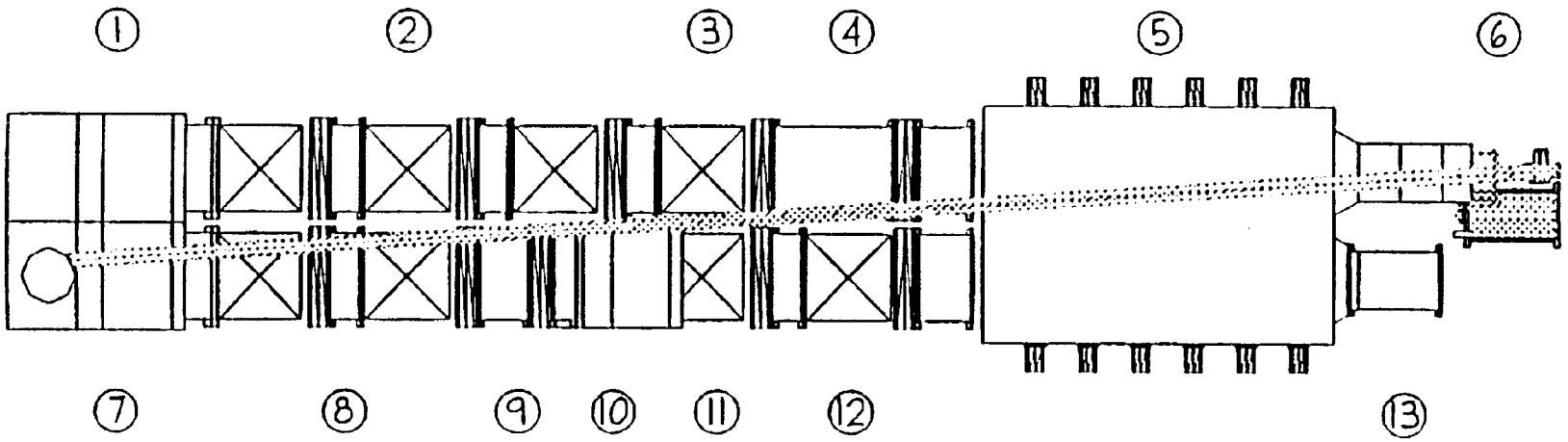
Figure 1B:
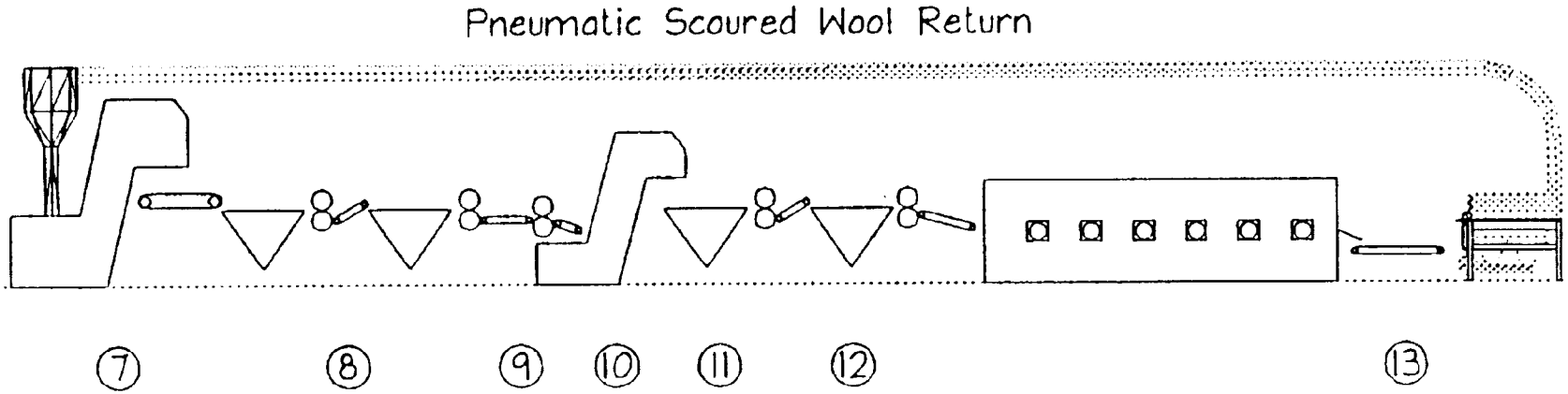
Figure 1C:
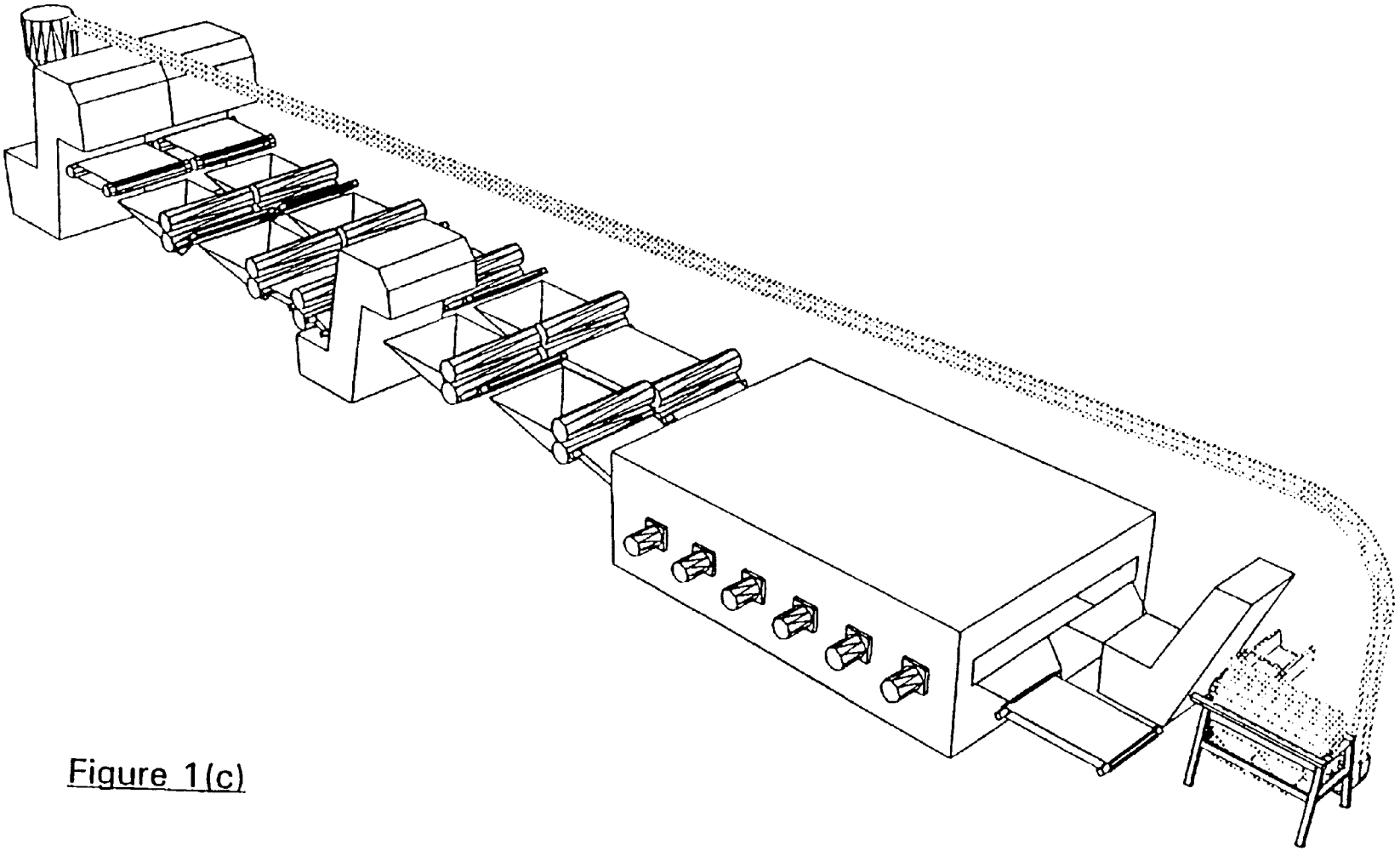
Figure 1D:
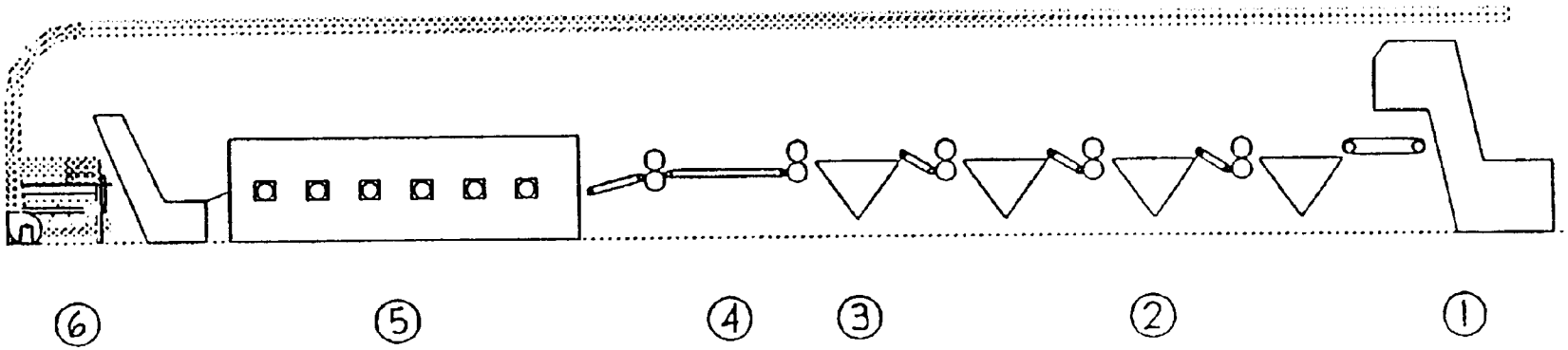

Describing the numbered features of FIGS. 1 (a to d).

| Number | Feature | Function |
|---|---|---|
| 1 | Greasy feed | Combination of feed hoppers and weighbelt to present even wool mat to scour. |
| 2 | Scouring bowls | Conventional wool scouring (mini) bowls containing detergent to remove woolgrease, suint, and dirt. |
| 3 | Rinsing bowl | Additional wool cleaning. |
| 4 | Peroxide applicator | Application of hydrogen peroxide solution to wool. |
| 5 | Twin channel dryer | Intermediate drying of wool to develop peroxide bleach and assist subsequent soil removal. |
| 6 | Scoured wool cleaner | Mechanical cleaner to remove larger particles of dirt from dry wool. |
| 7 | Scoured feed | Feed hopper to present even wool mat to second stage of scour. |

TABLE 1-continued

Describing the numbered features of FIGS. 1 (a to d).

| Number | Feature | Function |
|---|---|---|
| 8 | Polish scouring and dispersing | 2 scouring bowls containing detergent and dispersant to remove fine residual dirt, and chemical reducing agent to destroy peroxide residues. |
| 9 | Acid applicator | Application of acidic iron-complexing chemicals to wool for iron removal. Optionally may contain reducing agent. |
| 10 | Accumulator/hopper | Storage hopper to allow adequate reaction time for iron removal. |
| 11 | Neutralising bowl | Returns wool to neutral pH. |
| 12 | Hot rinse bowl or chemical application bowl | Removes remaining chemicals, and applies additional chemical treatments it required. |

The example shown in FIGS. 1(*a* to *d*) shows:

FIG. 1(*a*) is a plan view of the plant configuration;

FIG. 1(*b*) is an elevation view of the second stage plant shown in FIG. 1(*a*) incorporating the rescouring, and extraction, and neutralisation stages;

FIG. 1(*c*) is a perspective view of the plant shown in FIGS. 1(*a* to *b*); and FIG. 1(*d*) is an elevation view of the first part of the wet processing plant, including scouring and bleach application.

DESCRIPTION OF PREFERRED EMBODIMENTS

Within FIGS. 1(*a* to *d*), peroxide is applied by a pad applicator [4], dried onto the wool in the first dryer pass, and neutralised with reducing agent in the second bowl of the parallel train [8]. Alternatively, in other plant configurations, peroxide can be applied in a conventional bowl which may be bowl 3-6 of the first wet process stage prior to intermediate drying.

In this way, brightness enhancements of a further three Y units can be achieved with limited peroxide additions, and the yellowness (Y-Z) reduced down to a level below that of the original scoured wool, so that the wool is both much brighter and somewhat whiter than conventionally scoured wool. Colour stability may be very much retained after blank dyeing (ie, after boiling in a 'dyebath' without dyestuff) is shown by the results in Table 2.

These results are expressed in terms of 'base' colours, ie, when the wool is cleaned of all extraneous matter as in NZS 8707 1984.

TABLE 2

COLOUR PROPERTIES OF NORMALLY SCOURED, PEROXIDE BLEACHED, AND SUPERSCOURED WOOL

| | Y | Z | Y–Z |
|---|---|---|---|
| BEFORE BLANK DYEING | | | |
| Scoured only | 63.5 | 60.3 | 3.2 |
| Peroxide bleached | 68.1 | 68.4 | −0.3 |
| Peroxide bleached + reduction treatment in Superscouring | 69.5 | 68.5 | 1.0 |
| AFTER BLANK DYEING | | | |
| Scoured only | 65.7 | 59.7 | 6.0 |
| Peroxide bleached | 63.6 | 57.4 | 6.2 |
| Peroxide bleached + reduction treatment in Superscouring | 67.5 | 63.1 | 4.4 |

The peroxide bleached wool is initially of excellent colour, but on dyeing it becomes duller and quite yellow. The Superscoured wool in which the peroxide residues are neutralised (peroxide bleached and reduced) is much more colour stable when blank dyed, and remains substantially superior to the scoured-only material.

The incorporation into the arrangement in FIGS. 1(*a* to *d*) (or equivalent alternative second-stage bowl sequences) of extra scouring steps, in the first two bowls of the second stage of the process, enables very low residual grease levels to be obtained. Typical residual grease levels resulting from Superscouring, in a two-pass simulation of the process depicted in FIGS. 1(*a* to *d*), within the WRONZ pilot plant scour, are in the range 0.05–0.1% dichloromethane (DCM) extract plus a small component of detergent residue. Within this range, the material extracted is almost all internal cell membrane lipids from the fibre interior, and such figures imply virtually no superficial remaining wool lipid material. By contrast, conventionally scoured wool from the same plant will have DCM extract levels of 0.3–0.5%.

Table 3 below lists residual pesticide reduction on wool processed in such a double pass, in this case without acid extraction.

TABLE 3

PESTICIDE RESIDUE CONTENTS (μg/g) IN GREASY, NORMALLY SCOURED, AND SUPERSCOURED WOOL (FOLLOWING LIPID EXTRACTION WITH SUPERCRITICAL CARBON DIOXIDE)

| SAMPLE | GREASY | NORMALLY SCOURED | SUPERSCOURED |
|---|---|---|---|
| Propetamphos | 8.19 | 0.20 | 0.01 |
| Diazinon | 6.50 | 0.09 | 0.01 |
| Dichlofenthion | 6.13 | 0.13 | 0.02 |
| Chloropyriphos | 12.07 | 0.08 | 0.01 |
| Chlorfenvinphos | 7.42 | 0.13 | 0.01 |
| Cyhalothrin | 6.83 | 0.05 | 0.01 |
| Coumaphos | 12.34 | 0.12 | 0.01 |
| Cypermethrin | 9.52 | 0.08 | 0.01 |
| Deltamethrin | 7.60 | 0.03 | 0.00 |
| Total | 76.60 | 0.91 | 0.09 |

In the configuration of FIGS. 1(*a* to *d*) (or equivalent alternatives), detergents and dispersants are employed together in the first two bowls of the second bowl train [8], and in these bowls further effective residual soil removal from the wool is achieved. Such residual soil removal may be readily demonstrated by iron and aluminium analysis carried out on the wool, aluminium arising almost exclusively from superficial residual soil.

It is well known to the inventors, as part of our confidential prior art, that residual dirt on wool carpet yarns can present serious problems in yarn wet processing. This is a major well characterised problem in carpet yarn production, and is obviated by the removal of residual dirt in the process claimed herein.

Residual dirt is also undesirable in processing because it leads to contamination of equipment, especially cards, with sticky combinations of dirt, fibre debris, and processing lubricant. It is to be expected that the product from Superscouring will be preferred by spinners on process efficiency grounds, because of reduced frequency of card fettling (ie, cleaning).

Freedom from Dust

The process train in FIGS. 1(*a* to *d*) includes at an intermediate stage a scoured wool cleaner which is existing technology well known to be effective in removal of dust and short broken fibre.

Subsequent additional wet processing of this cleaned fibre will result in the removal of yet more dust and fine debris, therefore giving a product which is more free of dust than normal scoured wool.

If necessary, a second cleaning through a wool cleaner could be given at the end of the process.

Fine dust from wool processing is now acknowledged in some countries as a health hazard, and dust-free wools therefore have a market advantage.

Superscouring provides a product that is superior in this respect.

Freedom from Iron

As explained above, Superscoured wool has had the absorbed ferrous iron removed by acid extraction, and the superficial oxidised iron removed by detergents and dispersants in the second phase of wet treatment.

Superscoured wool therefore eliminates the potential dangers of iron-related processing problems for the spinner and carpet maker. Faulty carpet arising from minor iron compound variations in yarn, leading to stripes in the product, has been a major problem in industry, which is now able to be obviated by the use of Superscoured wool.

The way in which Superscoured wool provides more colour-stable yarn during chemical setting is exemplified in the following results from a laboratory simulation of tape-scour chemical setting over a duration of some 7½ hours (Table 4).

TABLE 4

COLOUR CHANGES IN YARN DURING PROLONGED CHEMICAL SETTING

| | | 'As-is' colour | | Base colour | |
|---|---|---|---|---|---|
| | | Y | Z | Y | Z |
| Normal scoured wool | Start of run | 58.3 | 56.8 | 60.9 | 59.7 |
| | End of run | 56.2 | 54.7 | 59.6 | 58.5 |
| Superscoured wool | Start of run | 63.0 | 63.3 | 65.1 | 65.8 |
| | End of run | 62.4 | 62.7 | 65.1 | 65.6 |

These results clearly show that the Superscoured wool changed hardly at all over the course of the run in base colour (ie, iron staining was nil) and that the 'as-is' colour change was also much reduced compared with normal scoured wool, indicating an absence of soil redeposition problems. The overall brightness and whiteness retention of the Superscoured product was clearly superior.

Process Parameters

The make-up of the various process bowls required to carry out all the above-mentioned processes, to achieve the benefits cited, is listed in the following Table 5. This summarises typical preferred ranges of concentration of chemicals, temperatures, and pH values where necessary.

Table 5 assumes all wet process operations are carried out in conventional bowls. However, it is possible with some simplification and space saving to replace chemical application stations with pad-store devices, taking the place of bowl 5 and bowls 8–9 in Table 5.

Such a configuration involving chemical padding is depicted in the integrated continuous process arrangement of FIGS. 1(*a* to *d*).

TABLE 5

CHEMICAL MAKE-UP OF BOWLS (OR PADDING BATHS) FOR SUPERSCOURING OF WOOL

| Bowl number in train | Process | Temperature (° C.) | Chemicals | Concentrations |
|---|---|---|---|---|
| 1–3 | Scouring | 60–65 | Nonionic detergent | 0.2–5 g/l |
| 4 | Rinsing | 60–65 | None | — |
| 5 | Bleaching | 60–65 | Hydrogen peroxide | 3–12 g/l |
| 6–7 | Extra scouring | 60–65 | Low foaming nonionic detergent | 0.5–5 g/l |
| | | | Dispersing agent | 0.3–1.0 g/l |
| | | | Sodium metabisulphite or sodium dithionite or other reducing agent (or optionally in bowl 8) | 0.3–2 g/l |
| 8–9 | Iron extraction | 65 | Sulphuric acid | pH 2.0–3.0 |
| | | | EDTA | 0.3–1.0 g/l |
| | | | Reducing agent optional | 0.3–2 g/l |
| 10 | Neutralising | 60–65 | Sodium carbonate/sodium bicarbonate (or $NH_3$) | 3–5 g/l pH 8–9 |
| 11 | Hot rinse | 60–65 | None | — |

Plant Configuration

While the individual process steps incorporated in Superscouring have been well characterised for some time, as pointed out above it has been difficult to undertake such processing in a conventional woolscour, because it could only be done in a double-pass operation with some penalties in cost, productivity, and difficulties in materials handling.

To achieve the full benefits of Superscouring, particularly the residual dirt and dust removal, and the intermediate peroxide bleaching process, it is necessary to dry the wool after the peroxide bleach application.

To envisage carrying out Superscouring in a single pass through a linearly arranged process train, one must then envisage, using normal scouring components, the following arrangements, in order: 3 hot scouring bowls, 1 warm rinsing bowl, 1 hot peroxide bleaching bowl, a dryer, a scoured wool cleaner, a hopper for relaying the wool mat, 2 second stage hot detergent/dispersant bowls, an acid extraction bowl, an alkaline neutralisation bowl, a hot rinse bowl, and a further dryer.

Such a process train would be relatively expensive, lengthy, difficult to house, and potentially difficult to manage.

What the inventors now claim are innovations in the selection, design and layout of plant components which minimise the stated disadvantages, and provide an efficient plant configuration in which Superscouring may be effectively carried out.

The innovations herein proposed are outlined as follows, and are depicted in FIGS. 1(*a* to *d*), wherein various features are numbered:

1. Wet process bowl steps may in some cases be replaced by double-squeeze roller padding systems which eliminate the need for a full wet process bowl. Such units are related to detergent double squeeze (DDS) units for which the inventors and their colleagues have applied for letters patent. An example is depicted in FIGS. 1(*a* to *d*) [4]. A similar system may be used for acid application [9]. In the latter case, completion of the acid extraction step is carried out during a dwell time in a small accumulator attached to a wet-feed hopper [10] which feeds the subsequent neutralisation bowl.
2. It has been appreciated that a potential simplification in plant layout can be achieved by bringing the two wet processing sections together in parallel, and combining the two drying operations within a single drying unit. After passing through one section of the wet process train, and through the dryer the first time, the wool is cleaned in a scoured wool cleaner and easily conveyed pneumatically or by conveyor, to the feed hopper of the second wet stage.

This has the following significant advantages:

(a) the high capital cost of two separate drying units may be substantially reduced.

(b) there are thermal energy savings possible by combining the two drying operations within the same insulated cabinet, and through more efficient usage of fans, coils, humid air, and heat recovery, thus reducing the cost of the two previous drying operations.

(c) the linear extent of the plant is much reduced, there are opportunities for cost elimination, and the 'footprint' of the plant on the factory floor is logistically much superior and easier to manage.

(d) the overall capital cost of such a plant will not be greatly more than that of one of the latest 8-bowl linear plant configurations now favoured in the industry.

The applicant believes that this novel configuration or a similar twin-train configuration represents a major advance towards achieving efficient Superscouring with all its attendant product benefits.

What is claimed is:

1. A fibre scouring process of at least two parts, wherein in a first part fibres are subjected to process steps to remove woolgrease and dirt, the process steps incorporating a peroxide bleaching step and drying, and wherein in a second part there is incorporated a step of subjecting the fibres to an acidic solution of a sequestering agent and a reducing agent to thereby remove absorbed iron, to bleach the fibre protein to thereby greatly improve the brightness (Y tristimulus value) of the fibres, remove peroxide residues from the fibres, stabilize the color benefit from any previous oxidative bleaching step, and prevent subsequent color deterioration during dyeing.

2. A fibre scouring process as claimed in claim 1 including at least six wet conventional bowl stages and wherein the bleaching peroxide is applied in one of bowls 3–6 prior to an intermediate drying stage.

3. A fibre scouring process as claimed in claim 1, wherein scoured clean fibres are dried and dusted, and then reimmersed in liquors containing detergents and dispersants, thereby effectively removing extra amounts of dirt.

4. A fibre scouring process as claimed in claim 1 comprising two separate stages of wet processing to thereby greatly reduce residual grease and residual pesticide levels and minimize dangers of market resistance associated with traces of animal-remedy pesticides.

5. A fibre scouring process as claimed in claim 1 wherein the beaching process uses peroxide and is applied by a pad applicator, dried onto the wool in a first dryer pass, and neutralized with reducing agent in a second bowl of a parallel train.

6. A fibre scouring process as claimed in claim 2 including scouring steps in the first two bowls of a second stage of the process after the intermediate drying stage, enabling very low residual grease levels to be obtained.

7. A fibre scouring process as claimed in claim 1 wherein the scouring process includes bringing two wet processing sections together in parallel, and combining the two drying operations within a single drying unit so that after passing through one section of the wet process train, and through the dryer the first time, the fibers are cleaned in a scoured fibre cleaner and easily conveyed pneumatically to a feed hopper of the second wet stage.

8. A fibre scouring process as claimed in claim 6 wherein detergents and dispersants are employed together in the first two bowls of the second bowl train with only very low levels of dissolved salts present, and in these bowls further effective residual soil removal from the fibre is achieved.

9. A fibre scouring process as claimed in claim 6 wherein the process train includes at an intermediate stage a scoured fibre cleaner for effective removal of dust and short broken fibre.

10. A fibre scouring process as claimed in claim 6 wherein subsequent additional wet processing of this cleaned fibre results in the removal of yet more dust and fine debris.

11. A fibre scouring process as claimed in claim 1 wherein a pad-store system is used for acid application and wherein completion of the acid extraction step is carried out during a dwell time in a small accumulator attached to a wet-feed hopper which feeds a subsequent neutralization bowl.

12. A fibre scouring process as claimed in claim 1 wherein the scouring process includes bringing two wet processing sections together in parallel, and combining the two drying operations within a single drying unit so that after passing through one section of the wet process train, and through the dryer the first time, the fibers are cleaned in a scoured fibre cleaner and easily conveyed pneumatically to a feed hopper of the second wet stage.

* * * * *